United States Patent [19]

Zopf

[11] Patent Number: 4,531,639

[45] Date of Patent: Jul. 30, 1985

[54] MANUFACTURING SUPPORT AND SHIPPING PACKAGE

[76] Inventor: David Zopf, 2602 Rockdale, Lansing, Mich. 48917

[21] Appl. No.: 532,318

[22] Filed: Sep. 15, 1983

[51] Int. Cl.[3] ..... B65D 85/30

[52] U.S. Cl. ..... 206/523; 206/3; 206/317; 206/328; 217/53; 248/632

[58] Field of Search ..... 206/3, 319, 328, 334, 206/521, 523, 524, 525, 584, 594, 592; 217/26.5, 35, 53; 248/632, 635

[56] References Cited

U.S. PATENT DOCUMENTS

| | | | |
|---|---|---|---|
| 2,064,751 | 12/1936 | Hussman . | |
| 2,158,783 | 5/1939 | Dean . | |
| 2,296,221 | 9/1942 | Pontis . | |
| 2,516,124 | 7/1950 | Kishibay | 206/334 |
| 2,674,370 | 4/1954 | Iredell | 206/319 |
| 2,722,307 | 11/1955 | Burke | 206/3 |
| 2,803,416 | 8/1957 | Berlien . | |
| 2,817,304 | 12/1957 | Newcomer et al. | 206/389 |
| 2,971,640 | 2/1961 | Snelling | 217/35 |
| 2,979,297 | 4/1961 | Suozzo . | |
| 2,982,395 | 5/1961 | Rados | 220/4 C |
| 3,063,664 | 11/1962 | Vazzano . | |
| 3,355,131 | 11/1967 | Fordeck et al. . | |
| 3,379,397 | 4/1968 | Keady et al. . | |
| 3,465,871 | 9/1969 | Lyons et al. | 206/3 |
| 3,478,869 | 11/1969 | Walters | 206/319 |
| 3,516,629 | 6/1970 | Say . | |
| 3,758,058 | 9/1973 | Neudeck et al. . | |
| 3,926,308 | 12/1975 | Sullivan | 206/565 |
| 4,069,992 | 1/1978 | Lada . | |
| 4,174,189 | 11/1979 | Elson . | |

FOREIGN PATENT DOCUMENTS

| | | | |
|---|---|---|---|
| 0527212 | 3/1954 | Belgium | 248/635 |
| 0528171 | 10/1954 | Belgium | 206/3 |
| 2317182 | 2/1977 | France | 206/523 |
| 0549321 | 2/1955 | Italy | 206/3 |
| 0858457 | 1/1961 | United Kingdom | 206/319 |

*Primary Examiner*—George E. Lowrance
*Assistant Examiner*—Jimmy G. Foster
*Attorney, Agent, or Firm*—Price, Heneveld, Huizenga & Cooper

[57] ABSTRACT

A packaging article for the handling of sensitive objects, that includes a semi-rigid foam case in which an elastomeric pad has been molded. A rigid support base is also molded within the case and supported on the elastomeric pad. The support base is covered by a release agent which prevents the casing material from permanently adhering to the support base, thus allowing the support base to shift within the case. A handling stand is secured to the sensitive object and may be used to support the object outside of the case. The handling stand mounts on the support base so that the support base handling stand assembly with the sensitive object mounted thereon floats or shifts within the case on the elastomeric pad without any other object surface contacting the support base.

6 Claims, 10 Drawing Figures

MANUFACTURING SUPPORT AND SHIPPING PACKAGE

BACKGROUND OF THE INVENTION

The present invention relates to packaging articles and in particular to packaging used in the handling and storage of sensitive objects.

Packaging designs vary according to a number of factors which include the sensitivity of the packaged article, the environment to which the package is to be used and such natural expediencies as stackability. The most prevelant packaging design found in the prior art comprises an exterior crate or carton that surrounds the stored object to protect the object from damage through contact with other objects. When packing is to be used for handling more sensitive objects, the exterior crate or carton is normally filled with a resilient packing material which surrounds the sensitive object. The exterior crate then provides a rigid protective shell while the resilient packing material provides any shock absorption necessary to protect the sensitive object within.

With the expansion of the computer component industry, as well as the advances being made in the areas of motor technology, robotics and complex medical equipment, the need for packing materials to be used in the storage and handling of internal replacement parts and the like for such sensitive equipment, as well as for other sensitive industrial devices has increased accordingly.

One problem experienced with existing packing methods is that the sensitive object must itself contact and rest upon the insulating or shock absorbing material. If the sensitive object has a large base which may be supported on the packing material, the resiliency of the packing material may be altered in order to provide the necessary cushioning. However, if the sensitive object has a relatively small support area, a packing material soft enough to provide the necessary cushioning may not also be rigid enough to support the sensitive object. The problems of adequately packing and protecting the object are particularly acute when dealing with sensitive devices that for various reasons cannot be contacted or supported with the exception of a support at a few discrete locations. In such applications the object is often difficult and cumbersome to handle and the packing material cannot adequately support and cushion the stored object without contacting undesirable locations on the sensitive object.

SUMMARY OF THE INVENTION

According to the present invention, these and other problems are solved in the prior art by provision of a packaging design that is capable of both meeting the long term storage requirements of a sensitive object in a hostile environment as well as meeting the short term handling requirements for the object just prior to insertion in the package and just after removal from the package. The packaging article of the present invention comprises a semi-rigid foam base or block that is cast around an internal rigid support structure. The rigid support structure provides a support to which the sensitive object is mounted and the support structure is covered with a release agent that prevents the foam block from permanently adhering to it. The support structure thus floats within the semi-rigid foam block, contacting and supporting the sensitive object at predetermined permissible locations while being resiliently movable within the foam block so that the supporting structure in contact with the sensitive object is not itself required to provide cushioning. Preferably, the rigid support structure floats or is shiftable within the foam block and rests upon an elastomeric pad that is cast into the block to compressibly absorb shocks imparted to the foam block. Further, the rigid support structure includes a removable stand and handle that is secured to the sensitive object to permit handling of the sensitive object when the object is outside of the foam block. This stand is mounted onto a nonremovable portion of the rigid support that is molded within the foam block.

With the present invention, sensitive objects may be stored and handled in hostile environments that involve rough treatment. Since the rigid support structure is the only portion of the packaging material that contacts the sensitive object, the support structure may be configured as desired in order to make contact with only specific locations on the object. The foam block provides the protection and cushioning necessary for the object, so that the exterior of the casing may be made of as rigid material as is necessary for the protective casing. Since the material that provides shock absorption does not itself contact the sensitive object, the cushioning material may be as resilient as is required for proper protection of the object while the base of the support structure may be altered as desired to provide proper support of the object's weight. Through the use of an internally molded elastomeric pad, high degrees of shock absorption may be provided without reaching the integrity of the outer casing.

Further, through the use of a separable support stand, the object may be handled and worked on prior to insertion and after withdrawal from the packaging without actually handling the object. As all the elements are formed from molded, synthetic materials, the packaging article may be easily and inexpensively manufactured without the use of specialized machinery.

These and other features and advantages of the invention will be apparent to one skilled in the art from the description, claims and drawings appended hereto.

DETAILED DESCRIPTION OF THE PREFERRED EMBODIMENT

Figure 5:
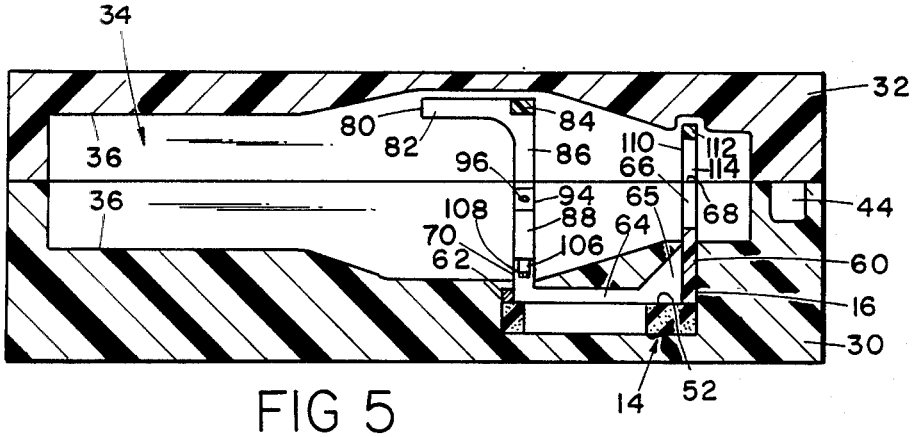
FIG. 5 is a sectional view taken along plane V—V of FIG. 1.
Figure 8:
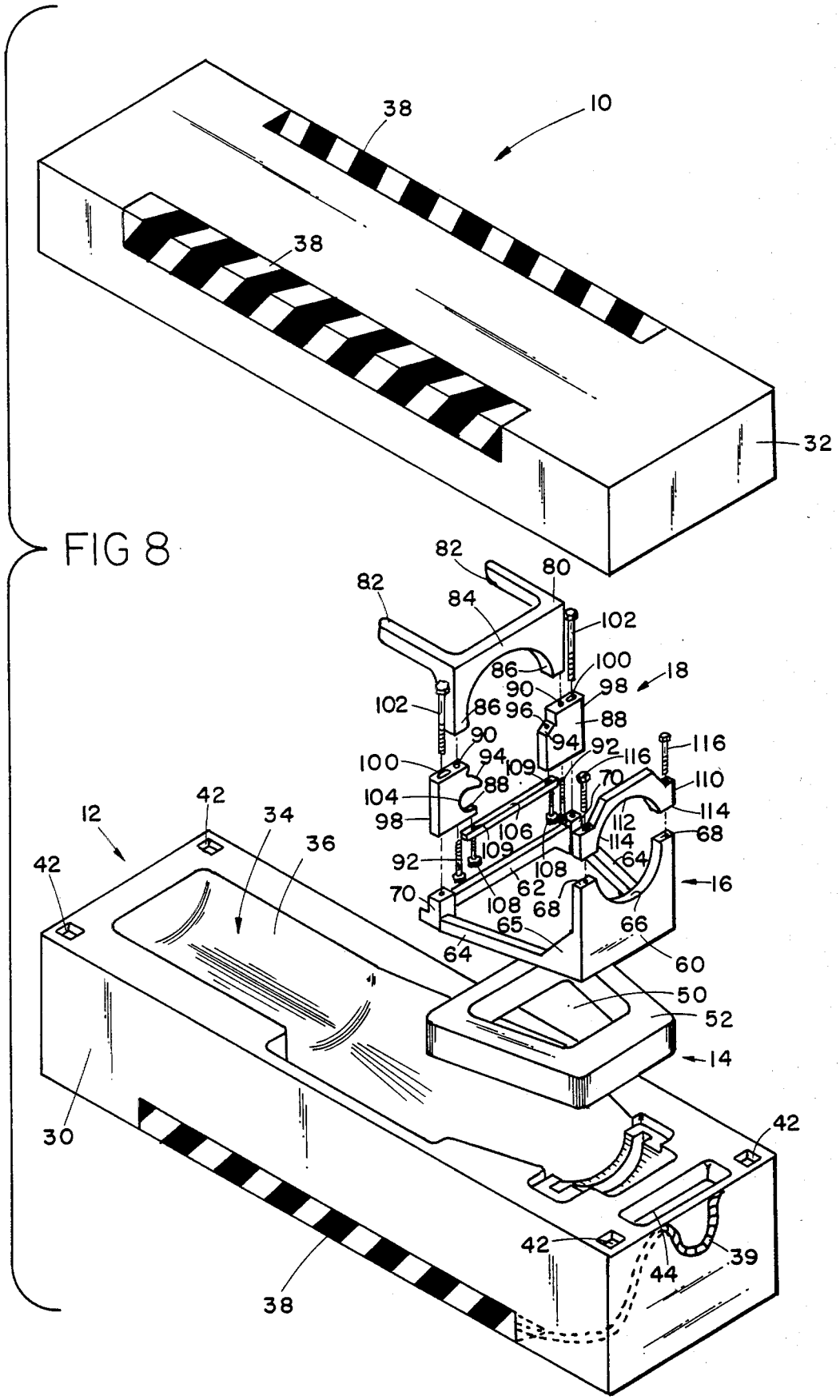
FIG. 8 is a perspective, exploded view of the packaging article of FIG. 1.

In the preferred embodiment shown in FIG. 8, a packaging article 10, includes a case or container 12 that has molded within it an elastomeric pad or cushion 14 and a rigid support base 16. As shown in FIG. 5, support base 16 rests directly upon pad 14. Support base 16 is covered with a release agent that prevents the material of case 12 from permanently adhering to base 16. A handling stand 18 is secured to the sensitive object 20 to be packaged, the stand being mounted in turn upon support base 16. Support base 16 therefore shifts or floats within case 12 while pad 14 and case 12 absorbs shocks. Thus, packaging article 10 packages and protects sensitive object 20 during handling, shipping and storage.

Figure 2:
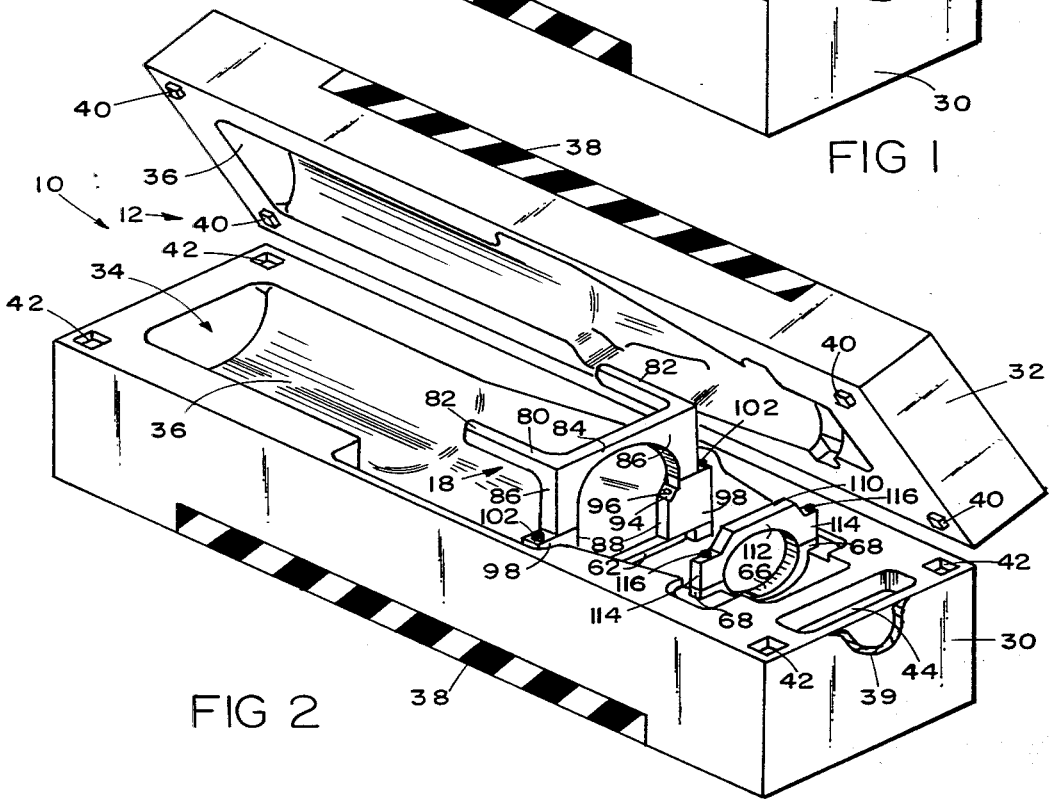
FIG. 2 is a perspective view of the packaging article of FIG. 1 shown in an open condition.

As shown in FIG. 2, packaging case 12 has a bottom block 30 and a mating top block 32. When top 32 and bottom 30 are joined together, case 12 has an elongated rectangular box-like shape. This box-like exterior configuration provides easy storage and handling, either as a single unit or when stacked with other packaging articles 10. Case 12 has an internal cavity 34 formed by cavity walls 36 within top block 32 and bottom block 30. Cavity 34 is configured to conform to the profile of sensitive object 20, but which is dimensioned to provide clearance around object 20. Cavity wall 36 will therefore encapsulate but remain completely out of contact with sensitive object 20. Although case 12 has a rigid, elongated rectangular block-like exterior, cavity 34 may have any desired configuration required. The thickness of the molded casing walls is therefore varied as required to provide a properly shaped cavity 34 for the particular object 20. Although the casing wall thickness may vary, sufficient wall material must be provided in order to provide case 12 with an at least semi-rigid protective exterior.

Figure 1:
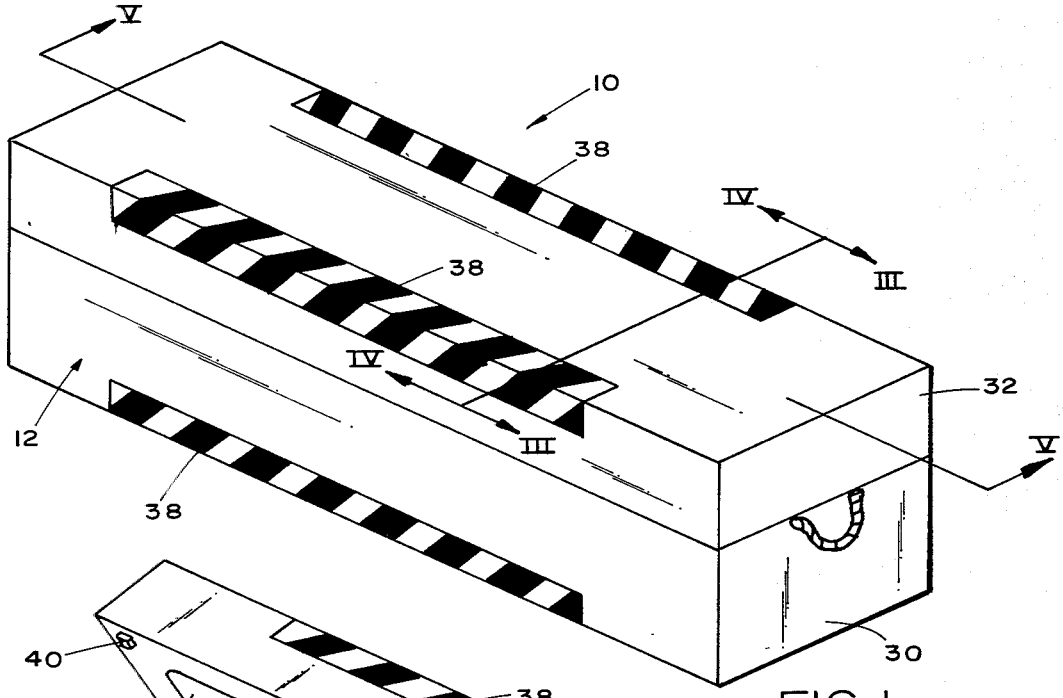
FIG. 1 is a perspective view of a packaging article embodying the present invention, shown in a closed condition.

As shown in FIG. 1, molded into case 12 along the four longitudinal edges are elongated reinforcing strips 38. Each strip 38 has an overall L-shaped cross section. Strips 38 reinforce case 12 against fracture along a medium vertical plane. Reinforcing strips 38 are bent corrugated cardboard reinforcements in which the corrugations run parallel to their length. As shown in FIG. 2, it may be desirable in some embodiments of the invention to provide four rectangular posts 40 which project from top 32 at the corners of the internal face in which cavity wall 36 is recessed. Posts 40 mate with four rectangular depressions 42 within the configured side of bottom 30. Post 40 and depressions 42 maintain top 32 and bottom 30 in proper alignment when case 12 is closed. Within bottom 30 is a recess or depression 44 which may be used for storage of informational material or spare parts related to the stored sensitive object 20.

Both bottom 30 and top 32 are pour molded foam blocks, molded from a rigid urethane foam material. One suitable foam material is marketed under the name PBO 22, by the Poly Blends company of Livonia, MI. Although other moldable materials may be used which possess the desired protective rigidity, PBO 22 permits a much larger case 12 to be molded without experiencing the problems of imperfect curing that are often experienced in molding large objects from other foam materials.

As shown in FIG. 8, elastomeric pad 14 is a trapezoidal, donut shaped pad or cushion having a central opening 50 and a flat upper surface 52. Pad 14 is a molded resilient synthetic or rubber which may be shaped to conform to the desired support base 16. Pad 14 is preferably molded from flexible urethane foam, two and one quarter inches thick. One such suitable material is marketed under the name PBO 22 by the Poly Blends company of Livonia, MI. Pad 14 is premolded to the desired shape, and then molded in situ during the pour molding of bottom block 30. The rigid foam material of bottom block 20 will therefore surround pad 14 and fill central opening 50 of pad 14 during the molding process. As shown in FIG. 5, elastomeric pad 14 is thus supported internally to block 30 with enough rigid foam material provided beneath pad 14 to provide rigidity adequate to support sensitive object 20.

Both the bottom 30 and top 32 of the case 12 are molded in complementary male and female molds. Although not illustrated herein, the male mold for the bottom 30 of the case 12 is provided with a plurality of apertures for receiving the upstanding ends of the rigid support base 16. The rigid support 16 and the elastomeric pad 14 are then properly positioned and molded into the bottom 30 of the case 12 by adhesively or otherwise suitably securing the pad 14 to the bottom of the support 16 and then inserting the upstanding ends of the support 16 into the apertures provided in the male mold just prior to closure of the mold. FIG. 8 also illustrates that a rope 39 is stapled or otherwise suitably secured to the elongated reinforcing strips 38 disposed on opposing sides of the bottom 30 of the case 12. The rope 39 is then draped outside of the mold cavity prior to closure of the mold to provide a handle that is later used to manipulate the completed package. One such handle is normally provided on each end of the package.

As shown in FIG. 5, support base 16 rests directly on top of upper surface 52 of pad 14. As shown in FIG. 8, support base 16 is generally trapezoidal in shape having a front vertical wall 60, a back bar 62 and converging side bars 64. Between front wall 60 and each side bar 64 is a gusset 65 that reinforce front wall 60. The upper surface of front wall 60 forms a concavely curved seat 66. Seat 66 is intermediate two raised flat mounting pads 68. Each mounting pad 68 includes a bolt aperture used in the mounting of sensitive object 20. Upstanding from each rear corner between side 64 and back bar 62 is a raised mounting pad or post 70 that also includes a mounting bolt aperture. Rear mounting pads 70 are not raised as high as front mounting pads 68 in order to accommodate the selectively removable mounting of handling stand 18 as explained in detail below.

As shown in FIG. 5, support base 16 is molded within bottom block 30 such that front mounting pads 68, curved seat 66 and back mounting pads 70 project into cavity 34. The remainder of front wall 60 as well as sides 64 and rear bar 62 are encapsulated beneath cavity 34 and held internally to bottom block 30. Covering support base 16 is a release agent which prevents the molding material of bottom 30 from permanently adhering to support base 16. Support base 16 is coated with the release agent prior to the molding of bottom 30. So coated, support base 16 is placed within the mold along with pad 14 and molded by standard molding techniques during the forming of bottom 30. It will be noted that front wall 60 as well as rear mounting posts 70 are all configured to have generally vertically oriented sides. The vertically oriented sides permit base 16 to slide straight down into block 30, compressing pad 14. Alternatively, front wall 60 or mounting posts 70 could have sloping sides that converge in an upward direction and still be permitted to be depressed onto pad 14. However, if any upright portion of base 16 is angled so as to be upwardly diverging, base 16 will be prevented from being depressed even though the material of bottom 30 is not permanently adhered to base 16. If support base 16 is so locked into bottom 30, any cushioning provided by article 10 would be provided by the resiliency of bottom block 30 itself.

Although various release agents may be suitably used, the preferred release agent is known as a Mold Release marketed under the trade name XMR-444 by the Chem Trend Company of Howell, MI. Foam material of bottom block 30 may adhere initially, to some degree, to support base 16. However, if the foam material does initially adhere, any impact will cause support base 16 to break free from bottom block 30 due to the release agent.

As shown in FIGS. 2 and 8, handling stand 18 includes a standard 80 having two parallel, elongated feet or floor runners 82. Feet 82 are joined by a curved joining section 84. From opposite sides of joining section 84 extend a pair of uprights 86. Each upright 86 includes a bolt aperture (not shown) that is used to connect standard 80 to the remainder of handling stand 18.

Figure 4:
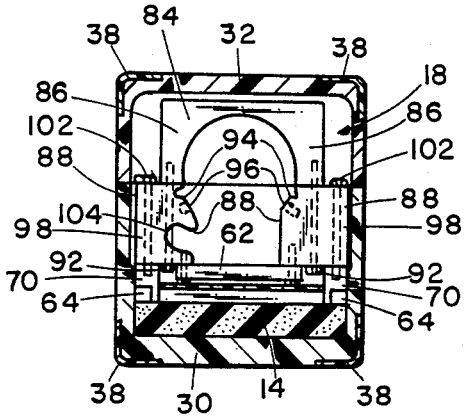
FIG. 4 is a sectional view taken along plane IV—IV of FIG. 1.
Figure 10:
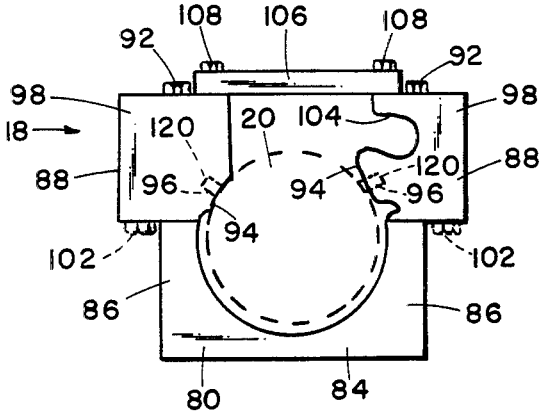
FIG. 10 is an end elevational view of the support stand of FIG. 7, shown with a sensitive article mounted thereon in phantom.

As shown in FIGS. 4, 8 and 10, a pair of spacer or side connecting blocks 88 are each bolted through a bolt channel 90 to an upright 86 by side bolt 92. When oriented as shown in FIGS. 4 and 8, on the inner facing sides of each side block 88 is a downwardly converging, angled surface 94. Extending into each angled surface 94 is an object mounting blind depression 96. Depression 96 is used in the mounting of sensitive object 20 as described below. When bolted to standard 80, blocks 88 have outwardly extending sides 98 that extend to the sides of uprights 86. Through each outwardly extending side 98 is a slot or channel 100. A mounting bolt 102 is received through each channel 100 to bolt blocks 88 to back mounting pads 70 on support base 16. Sides 98 extend to the sides of uprights 86 so that an assembler may access bolts 102 during the mounting of handling stand 18 onto support base 16. Side blocks 88 may have removed portions 104 as required to provide clearance around sensitive object 20. A straight bar or handle 106 is bolted between blocks 88. Handle 106 is bolted to the side of blocks 88 opposite standard 80. Handle 106 is secured by handle bolts 108 that pass through slots or channels 109. When connected by standard 80 and handle 106, side blocks 88 are rigidly prevented from separating. Handle 106 also provides a means for carrying handling stand 18 when object 20 is mounted thereon.

Figure 3:
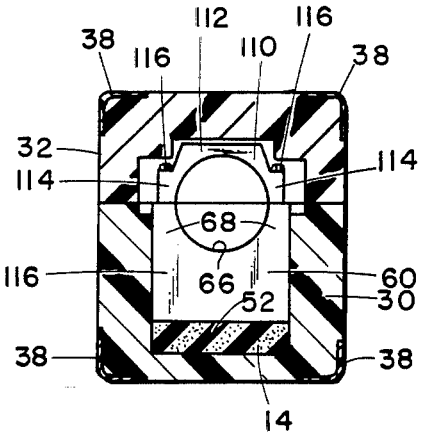
FIG. 3 is a sectional view taken along plane III—III of FIG. 1.

As shown in FIGS. 3 and 8, a front collar 110 is mounted on front wall 60. Collar 110 has a curved seat 112 and two side blocks 114 which mate with and are connected to front mounting pads 68 by bolts 116. Curved seat 112 and curved seat 66 on base 16 form a rigid, continuous circular collar used in the mounting of sensitive object 20.

Figure 9:
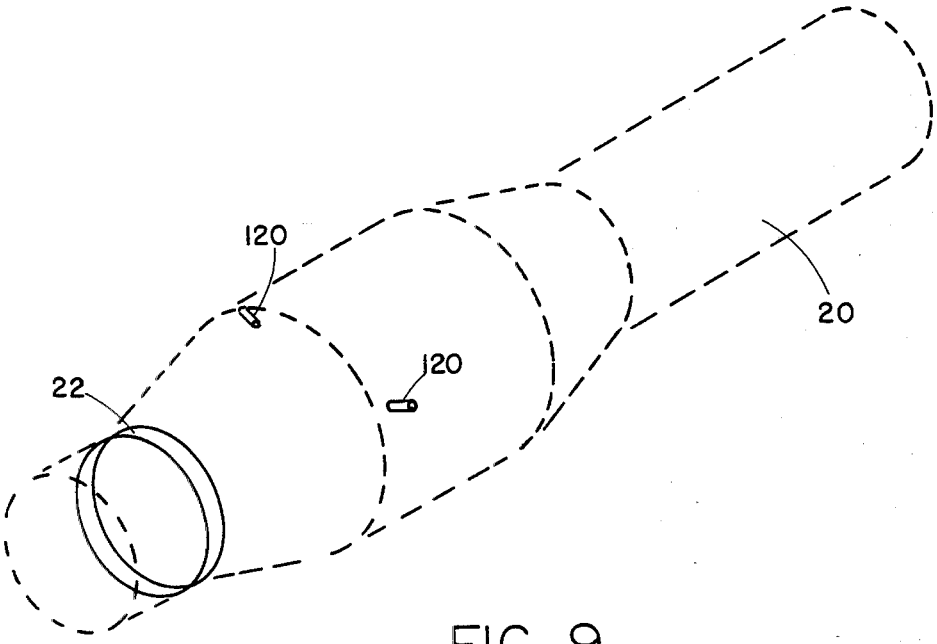
FIG. 9 is a perspective view of a sensitive object to be packaged, showing the various contact points by which the object may be mounted.

A representative configuration for a sensitive object 20 is shown in FIG. 9. Although object 20 is shown in FIG. 9 as being generally cylindrical in shape, object 20 may have other configurations. As shown in FIG. 9, sensitive object 20 has a spaced pair of posts 120 that are oriented to form an angle of approximately one hundred and twenty degrees with each other. A circular band 122 is located at one end of object 20. Band 122 may be used along with posts 120 as contact locations to support object 20. Although object 20 is depicted as allowing contact at only posts 120 and band 122, any variety of contact locations may be provided. For example, object 20 could have a plurality of bands 122, or only a plurality of variously spaced posts 120.

OPERATION

Packing article 10 may be used for the handling of sensitive object 20 when object 20 is either inside or outside of case 12. Handling stand 18 may therefore be used during the manufacture of object 20 as a part of the manufacturing jig and then be transferred with object 20 to case 12 for storage. Alternatively, handling stand 18 may be used in addition to another mechanical manufacturing jig and secured to sensitive object 20 for transport.

In order to assemble packaging article 10, handling stand 18 is first assembled onto the sensitive object 20. With object 20 supported on a manufacturing jig or the like, standard 80 is placed underneath object 20 as shown in FIG. 10. As shown in FIG. 10, object 20 is raised above joining section 84. Uprights 86 are spaced to the sides of object 20. Joining section 84 and uprights 86 therefore remain out of contact with object 20 at all times. Side blocks 88 are placed on sensitive object 20 with posts 120 being received within mounting depressions 96. Bolts 92 are passed through blocks 88 and bolted into uprights 86. Handle 106 is then bolted to the top of side blocks 88 by bolts 108 so that blocks 88 are prevented from separating. As shown in FIG. 8, bolt slots 109 are slightly laterally elongated in order to accommodate any separation of blocks 88 required to properly mount object 20. Once bolted to side blocks 88 however, handle 106 rigidly prevents any shifting of blocks 88.

Figure 7:
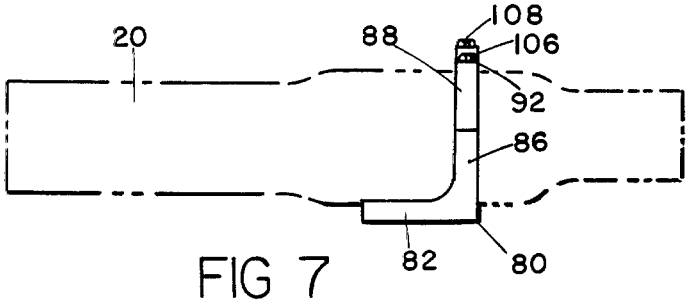
FIG. 7 is a side elevational view of a support stand used with the packaging article of FIG. 2, shown with a sensitive object mounted thereon in phantom.

As shown in FIG. 10, posts 120 form a slightly downward converging angle. When side blocks 88 are fixed in place sensitive object 20 is thus suspended between side blocks 88. As shown in FIG. 7, sensitive object 20 may then be removed from the manufacturing jig and carried by handle 106. Handling stand 18 may be rested on feet 82 on a floor surface and support object 20. Feet 82 extend to the rear of sensitive object 20 sufficient to pass under the center of gravity of object 20 and therefore prevent object 20 from tipping over.

Figure 6:
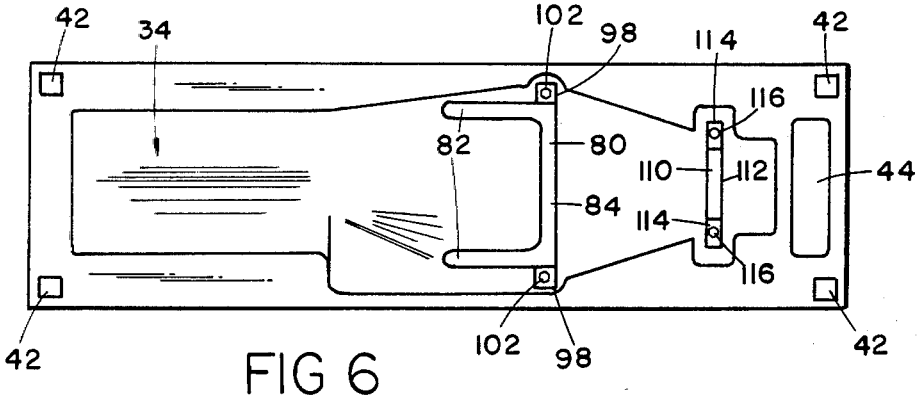
FIG. 6 is a top plan view of the lower portion of the packaging article shown in FIG. 2 in an open condition.

In order to place object 20 within case 12, handling stand 18 is lifted by handle 106 and then inverted by grasping feet 82. Using feet 82 as handles, object 20 is lowered into cavity 34 within bottom block 30 until outwardly extending sides 98 on side blocks 88 contact rear mounting pads 70, as shown in FIGS. 5 and 6. Side blocks 88 are then bolted to rear mounting pads 70 by side mounting bolts 102 as shown in FIG. 4. Bolt slots 100 are slightly laterally elongated in order to accommodate any separation of side blocks 88 necessary for the proper mounting of object 20. Front collar 110 is then placed over circular band 122 which has come to rest on curved seat 66 of front wall 60. Front collar 110 is bolted by bolts 116 to mounting pads 68. So secured, curved seat 112 stabilizes sensitive object 20 within cavity 34. Top block 32 is then placed over object 20 with handling stand 18 and is hermetically sealed to bottom block 30. It will be noted that object 20 is held completely out of contact with top and bottom blocks 32, 30. Object 20 is therefore contacted only at posts 120 and band 122 by the rigid support structure.

As case 12 is handled, support base 16 floats within lower block 32 due to the resilient compression of elastomeric pad 14. Therefore, as foreign objects strike case 12 or case 12 is jarred, pad 14 absorbs the impact. Case 12 is sufficiently rigid to deflect such impacts, but since case 12 is a foam article case 12 itself absorbs some of the shock of such impacts. Case 12 can then be inserted in a corrugated box for shipment and non-descript storage.

It is to be remembered that the particular handling stand 18 described is particularly suited to an object 20 having the three contact points described. However, the configuration of handling stand 18 as well as support base 16 may be altered as required by the design of sensitive object 20. For instance, feet 82 on handling stand 18 may be greatly elongated in order to operate as a stable standard for a different object 20. Similarly, support base 16 could be greatly enlarged along with elastomeric pad 14. The elastic characteristics of elastomeric pad 14 may be altered in order to either increase or decrease the cushioning effect produced. Alternatively, if a high degree of cushioning is not required, pad 14 may be removed and bottom block 30 may be molded of a much softer rubber material. In such an application in which an elastomeric pad is lacking, support base 16 will be supported directly on bottom block 30 and cushioning will be provided by the compression of the bottom block 30 foam material.

It is to be recognized that the above is merely a description of the preferred embodiment and that one skilled in the art will recognize that various modifications or improvements may be made without departing from the spirit of the invention disclosed therein. The scope of protection provided is to be determined by the claims which follow and the breadth of interpretation which the law allows.

The embodiments of the invention in which an exclusive property or privilege is claimed are defined as follows:

1. A package for handling sensitive objects comprising:

an elastomeric pad;

a rigid support structure having a base resting on said elastomeric pad;

gripping means for engaging said sensitive object, said gripping means being disposed on said support structure;

a coating of release agent disposed on the surface of said rigid support structure;

a molded at least semi-rigid foam block forming a container for receiving said sensitive object, said elastomeric pad and said rigid support structure being embedded and at least partially molded into said foam container, said gripping means being disposed outside of said block to facilitate engagement of said sensitive object; and said base having a substantially horizontal surface fully supported by said elastomeric pad, said rigid support structure being vertically oriented over said elastomeric pad, and said rigid support structure having sides which extend between said base and said gripping means in a range from substantially vertical to inwardly sloping to provide for the vertical displacement of said rigid support structure, relative to said container, upon compression of said elastomeric pad; whereby the weight of said sensitive object is supported and cushioned from shock by the compression of said elastomeric pad and the reciprocating vertical displacement of said rigid support structure relative to said container.

2. The package of claim 1 wherein said gripping means further comprises a handle secured to said sensitive object for transporting said object separate from said foam block, said handle being selectively, fixedly secured to said support structure.

3. The package of claim 2 wherein said handle further comprises a stand for supporting said sensitive object on the ground independent of said foam block.

4. The package of claim 1 wherein said foam block is provided with a cavity therein configured to encapsulate said sensitive object, said gripping means disposed within said cavity.

5. The package of claim 4 wherein said cavity in said foam block is configured so as to encompass but remain out of contact with said sensitive object, said sensitive object being engaged only by said support structure.

6. The package of claim 1 wherein said foam block has longitudinal edges, said foam block having reinforcing strips extending along a substantial portion of said edges.

* * * * *